United States Patent [19]

Nakaniwa et al.

[11] Patent Number: 4,926,826

[45] Date of Patent: May 22, 1990

[54] ELECTRIC AIR-FUEL RATIO CONTROL APPARATUS FOR USE IN INTERNAL COMBUSTION ENGINE

[75] Inventors: Shimpei Nakaniwa; Toshibumi Itoh, both of Isesaki, Japan

[73] Assignee: Japan Electronic Control Systems Co., Ltd., Gunma, Japan

[21] Appl. No.: 236,223

[22] Filed: Aug. 25, 1988

[30] Foreign Application Priority Data

Aug. 31, 1987 [JP] Japan ..... 62-215191
Sep. 11, 1987 [JP] Japan ..... 62-226607

[51] Int. Cl.[5] ..... F02M 51/00
[52] U.S. Cl. ..... 123/489; 123/440
[58] Field of Search ..... 123/489, 440, 486, 489, 123/478

[56] References Cited

U.S. PATENT DOCUMENTS

| | | | |
|---|---|---|---|
| 4,615,319 | 10/1986 | Tomisawa | 123/440 |
| 4,655,188 | 4/1987 | Tomisawa | 123/489 |
| 4,694,805 | 9/1987 | Yatabe et al. | 123/489 |
| 4,707,241 | 11/1987 | Nakagawa et al. | 123/489 |
| 4,712,529 | 12/1987 | Terasaka et al. | 123/489 |
| 4,715,344 | 12/1987 | Tomisawa | 123/489 |
| 4,729,359 | 3/1988 | Tomisawa | 123/440 |
| 4,738,238 | 4/1988 | Ohishi | 123/489 |
| 4,741,312 | 5/1988 | Ohishi | 123/489 |
| 4,771,753 | 9/1988 | Ohishi | 123/489 |
| 4,777,922 | 10/1988 | Mieno et al. | 123/489 |

FOREIGN PATENT DOCUMENTS 61-182846 11/1986 Japan .

*Primary Examiner*—Raymond A. Nelli
*Attorney, Agent, or Firm*—Sandler, Greenblum & Bernstein

[57] ABSTRACT

An electric air-fuel ratio control apparatus for use in an internal combustion engine provided with an oxygen sensor detecting an oxygen concentration in an exhaust gas from the engine and having such an output characteristic that the output value thereof is gradually changed with the oxygen concentration corresponding to the air-fuel ratio in a zone in the vicinity of a theoretical air-fuel ratio is disclosed. The air-fuel ratio control is performed by controlling a fuel injection quantity which is calculated mainly based on a basic fuel injection quantity and an air-fuel ratio correction coefficient in response to an output from the oxygen sensor and is performed in a manner of integration control. The control results in that it is possible to specify the air-fuel ratio in the zone in the vicinity of the aimed-value i.e. the theoretical air-fuel ratio by using the oxygen sensor according to the present invention and accordingly no response delay of the control is caused. The integration control of the fuel injection quantity is also effected by changing the integration constant based on a deviation of the output level of the oxygen sensor from the aimed-value or by setting the air-fuel ratio feedback correction coefficient based on the deviation and a differential value of the detected air-fuel ratio. An oxygen sensor with a nitrogen oxide-reducing capacity may be utilized as the oxygen sensor.

23 Claims, 17 Drawing Sheets

| E \ ΔE | NB | NM | NS | 0 | PS | PM | PB |
|---|---|---|---|---|---|---|---|
| PB | 0 | NS | NM | NB | NB | NB | NB |
| PM | PS | 0 | NS | NM | NB | NB | NB |
| PS | PM | PS | 0 | NS | NM | NB | NB |
| 0 | PB | PM | PS | 0 | NS | NM | NB |
| NS | PB | PB | PM | PS | 0 | NS | NM |
| NM | PB | PB | PB | PM | PS | 0 | NS |
| NB | PB | PB | PB | PB | PM | PS | 0 |

ELECTRIC AIR-FUEL RATIO CONTROL APPARATUS FOR USE IN INTERNAL COMBUSTION ENGINE

BACKGROUND OF THE INVENTION (1) Industrial Application Field of the Invention The present invention relates to an electric air-fuel ratio control apparatus in an internal combustion engine. More particularly, the present invention relates to a electric feedback correction control system in which an oxygen concentration in an exhaust gas is detected, the air-fuel ratio of an air-fuel mixture sucked in the engine is detected based on this oxygen concentration and the fuel injection quantity is controlled by feedback correction to bring the actual air-fuel ratio close to the theoretical air-fuel ratio.

(2) Description of the Related Art

A conventional electronically controlled fuel injection apparatus which is provided in an internal combustion engine has an electromagnetic fuel injection valve in an intake system of the engine. Some of the conventional apparatus have been provided by the applicant as U.S. Pat. Nos. 4,615,319, 4,655,188, 4,729,359 and 4,715,344 or U.S. patent application Nos. '87 97,682, '87 98,038 and '88 179,535.

In these electronically controlled fuel injection apparatus, a basic fuel injection quantity $T_p$ ($=K\times Q/N$; K is a constant) is calculated from a sucked air flow quantity Q of the engine detected by an air flow meter and an engine revolution number N detected by an engine revolution speed sensor such as a crank angle sensor, and a correction coefficient COEF including various correction coefficients corresponding to engine driving conditions such as an engine temperature, an air-fuel ratio feedback correction coefficient LAMBDA and others are calculated. The basic fuel injection quantity $T_p$ is corrected according to the calculation result to set a final fuel injection quantity $Ti(=T_p\times COEF\times LAMBDA+Ts)$. Ts stands for a correction quantity pertaining to a fluctuation of a battery voltage.

A driving pulse signal having a pulse width corresponding to the so-set fuel injection quantity Ti is put out to an electromagnetic fuel-injecting valve at a predetermined timing to inject and supply a preferable amount of a fuel to the engine.

The air-fuel ratio feedback correction coefficient LAMBDA is to control the air-fuel ratio of the air-fuel mixture sucked in the engine to a predetermined target or aimed air-fuel ratio (the theoretical air-fuel ratio), and the value of the air-fuel ratio feedback correction coefficient LAMBDA is changed by the proportion-integration (PI) control to control the air-fuel ratio stably.

More specifically, an oxygen sensor in which the electromotive force abruptly changes at the theoretical oxygen concentration ratio in the exhaust gas, attained on combustion of the air-fuel mixture at the theoretical air-fuel ratio, and the electromotive force is high in case of a rich air-fuel mixture and the electromotive force is low in case of a lean air-fuel mixture (Japanese Unexamined Utility Model Publication No. 61-182846) is disposed in the exhaust system of the engine. The output voltage from this oxygen sensor is compared with a predetermined reference voltage (slice level) and it is judged whether the air-fuel ratio of the air-fuel mixture sucked in the engine is richer or leaner as compared with the theoretical air-fuel ratio. In the case where the air-fuel ratio is lean (rich), the air-fuel ratio feedback correction coefficient is gradually increased (decreased) by predetermined integration quantity (portion I) to increase (or decrease) and correct the fuel injection quantity Ti and accordingly the air-fuel ratio is easily controlled to the theoretical air-fuel ratio.

The air-fuel ratio feedback correction coefficient LAMBDA is thus set based on the rich-lean judgment of the air-fuel ratio detected by the oxygen sensor to bring the actual air-fuel ratio close to the theoretical air-fuel ratio, and if this control is performed, since a ternary catalyst effectively acts at the theoretical air-fuel ratio, good exhaust gas characteristics can be maintained.

In the case where the air-fuel ratio is controlled in the above-mentioned manner by using the oxygen sensor when the air-fuel ratio feedback correction coefficient LAMBDA is changed by the integration control with a predetermined constant integration quantity, a response delay of the control is caused at the time of rich-lean reversion. Namely, when rich (lean)-to-lean (rich) reversion is judged, since a certain deviation from the theoretical air-fuel ratio has already been estimated, if it is intended to restore the theoretical air-fuel ratio in this state by the constant integration control, a long time is required and therefore, the width of the air-fuel ratio controlled by the air-fuel ratio feedback control is increased (FIG. 20).

Accordingly, this response delay should be eliminated by the proportion control. However, abrupt change of the air-fuel ratio feedback correction coefficient LAMBDA by the proportion control cannot be avoided in the prior control system. The air-fuel ratio obtained by changing the air-fuel ratio feedback correction coefficient LAMBDA is changed substantially at the same frequency of the change of the air-fuel ratio feedback correction coefficient LAMBDA under a strong influence of the abrupt change of the air-fuel ratio feedback correction coefficient LAMBDA and by the change (surge) of the output of the engine caused by the change of the air-fuel ratio, a minute horizontal vibration is generated in a vehicle.

In order to prevent this horizontal vibration of the vehicle, it may be necessary to stabilize the combustion by advancing the ignition timing. However, if the ignition timing is advanced, the combustion temperature rises and the content of nitrogen oxides $NO_x$ will increase.

Incidentally, in the afore-mentioned control system for air-fuel ratio feedback correction coefficient, since the output of the oxygen sensor abruptly changes at the theoretical air-fuel ratio(FIG. 7), the theoretical air-fuel ratio can hardly be specified based on the output of the oxygen sensor. In other words, since the electromotive force output from the oxygen sensor corresponding to the theoretical air-fuel ratio is within a certain range, there may be an apprehension that it can be judged whether the air-fuel ratio is rich or lean as compared with the theoretical air-fuel ratio. In order to prevent such a problem, it may be necessary to use a type of oxygen sensor in which the output of which has a value that gradually changes in the vicinity region of the theoretical air-fuel ratio.

On the other hand, in the conventional air-fuel ratio feedback control system, the control is performed only based on the large-small relation of the air-fuel ratio to the target air-fuel ratio as discussed above, and the response characteristic of the actual oxygen sensor to the change of the air-fuel ratio is about 100 ms at highest and when the output voltage of the oxygen sensor crosses the slice level voltage, the actual air-fuel ratio is greatly changed from the target air-fuel ratio to the rich side or the lean side, resulting in insufficient control (hatched region in FIG. 20). Accordingly, the overshoot or undershoot quantity is increased to increase the variation width of the air-fuel ratio and degrade the convergence to the target air-fuel ratio, with the result that the driving characteristic is degraded by the surge torque and the discharge quantities of CO, HC and $NO_x$ are increased.

SUMMARY OF THE INVENTION

In view of the foregoing problems provided by the conventional technique, it is a principal object of the invention to provide an electric air-fuel ratio control apparatus in which in setting the air-fuel ratio feedback correction coefficient, even if the proportion control is not performed at the time of reversion of the air-fuel ratio, no response delay of the control and specifying the air-fuel ratio in the vicinity of the theoretical air-fuel ratio based on an output from an oxygen sensor are effectively caused.

It is another object of the present invention to provide an electric air-fuel ratio control apparatus in which an oxygen sensor having such an output characteristic that the output value is gradually changed with the oxygen concentration in the vicinity of the theoretical air-fuel ratio is used, thereby specifying the air-fuel ratio in the region including the theoretical air-fuel ratio can be attained.

It is a further object of the present invention to provide an electric air-fuel ratio control apparatus in which in order to achieve the principal object of the present invention, by the integration control, the air-fuel ratio feedback correction coefficient is gradually changed to control the actual air-fuel ratio to the theoretical air-fuel ratio which is the target air-fuel ratio.

It is still a further object of the present invention to provide an electric air-fuel ratio control apparatus in which in order to achieve the principal object of the present invention, in addition to gradual control the air-fuel ratio feedback correction coefficient by the integration control, the variation of the air-fuel ratio is effectively controlled to increase the convergence to the target air-fuel ratio, by setting the feedback correction coefficient based on the deviation of the air-fuel ratio from the target air-fuel ratio and the differential value (change speed) of the air-fuel ratio, whereby hunting by insufficient control is prevented, the surge torque (horizontal shaking of a vehicle) is reduced to improve the driving characteristic and the exhaust gas-purging capacity is improved.

It is still a further object of the present invention to provide an electric air-fuel ratio control apparatus having an oxygen sensor with a nitrogen oxide-reducing capacity thereby the accurate oxygen concentration can be detected for use in the air-fuel ratio feedback control of the present invention. This kind of the oxygen sensor is provided in U.S. patent application Nos. 07/117,507 and 07/117,516 by the applicant.

For attaining the above-mentioned objects, the present invention provides an electric air-fuel ratio control apparatus for use in an internal combustion engine, which comprises, as shown in FIG. 1, the following means (A) through (H): for (A) an engine driving state-detecting means detecting the driving state of the engine;

(B) a basic fuel injection quantity-setting means for setting a basic fuel injection quantity based on the engine driving state detected by the engine driving state-detecting means; for (C) an oxygen concentration-detecting means detecting an oxygen concentration in an exhaust gas, which has such an output characteristic that the output value gradually changes with the oxygen concentration in a zone in the vicinity of the theoretical air-fuel ratio of an air-fuel mixture sucked in the engine;

(D) an air-fuel ratio-judging means for comparing the output value of the oxygen concentration-detecting means with a predetermined output value corresponding to the theoretical air-fuel ratio and judging whether the air-fuel ratio of the air-fuel mixture sucked in the engine is rich or lean as compared with the theoretical air-fuel ratio;

(E) an air-fuel ratio feedback correction coefficient-setting means for increasing or decreasing and setting, by integration control based on a predetermined integration constant, an air-fuel ratio feedback correction coefficient for correcting the basic fuel injection quantity based on the result of the judgment of the air-fuel ratio-judging means to bring the actual air-fuel ratio close to the theoretical air-fuel ratio;

(F) a fuel injection quantity-setting means for setting a fuel injection quantity based on the basic fuel injection quantity set by the basic fuel injection quantity-setting means and the air-fuel ratio feedback correction coefficient set by the air-fuel ratio feedback correction coefficient-setting means;

(G) a fuel injecting means for injecting fuel into the engine; and (H) a driving signal output means for putting out a driving signal corresponding to the fuel injection quantity set by the fuel injection quantity-setting means to a fuel-injecting means in an on-off manner.

According to another aspect, the present invention provides an electric air-fuel ratio control apparatus for use in an internal combustion engine which further comprises, in addition to the first aspect of the present invention, (I) an air-fuel ratio deviation calculating means for determining a deviation of the output value of the oxygen concentration-detecting means from the predetermined output value corresponding to the theoretical air-fuel ratio and (J) an integration constant setting means for setting an integration constant for integration control according to said deviation shown in FIG. 11. In this case, the air-fuel ratio feedback correction coefficient-setting means increases or decreases and sets the air-fuel ratio feedback correction coefficient for correcting the basic fuel injection quantity based on the result of the judgment of the air-fuel ratio-judging means to bring the actual air-fuel ratio close to the theoretical air-fuel ratio by the integration control based on the integration constant set by the integration constant-setting means.

According to a further aspect, the present invention provides an electric air-fuel ratio control apparatus for use in an internal combustion engine which further comprises, in addition to the first aspect of the present invention besides the means (C) and (D), (I) a deviation-calculating means for calculating a deviation of the detected air-fuel ratio from a target air-fuel ratio and judging whether the air-fuel ratio of the air-fuel mixture sucked in the engine is rich or lean as compared with the theoretical air-fuel ratio and (K) a differential value-calculating means for calculating a differential value of the detected air-fuel ratio. In this aspect, the feedback correction coefficient-setting means sets a feedback correction coefficient for the feedback correction of the basic fuel injection quantity based on the deviation and the differential value.

The present invention will now be described in detail with reference to optimum embodiments illustrated in the accompanying drawings, but the present invention is not limited by these embodiments and the present invention includes changes and modifications within the range of objects and the technical scope of the present invention.

DETAILED DESCRIPTION OF THE PREFERRED EMBODIMENTS

Figure 2:
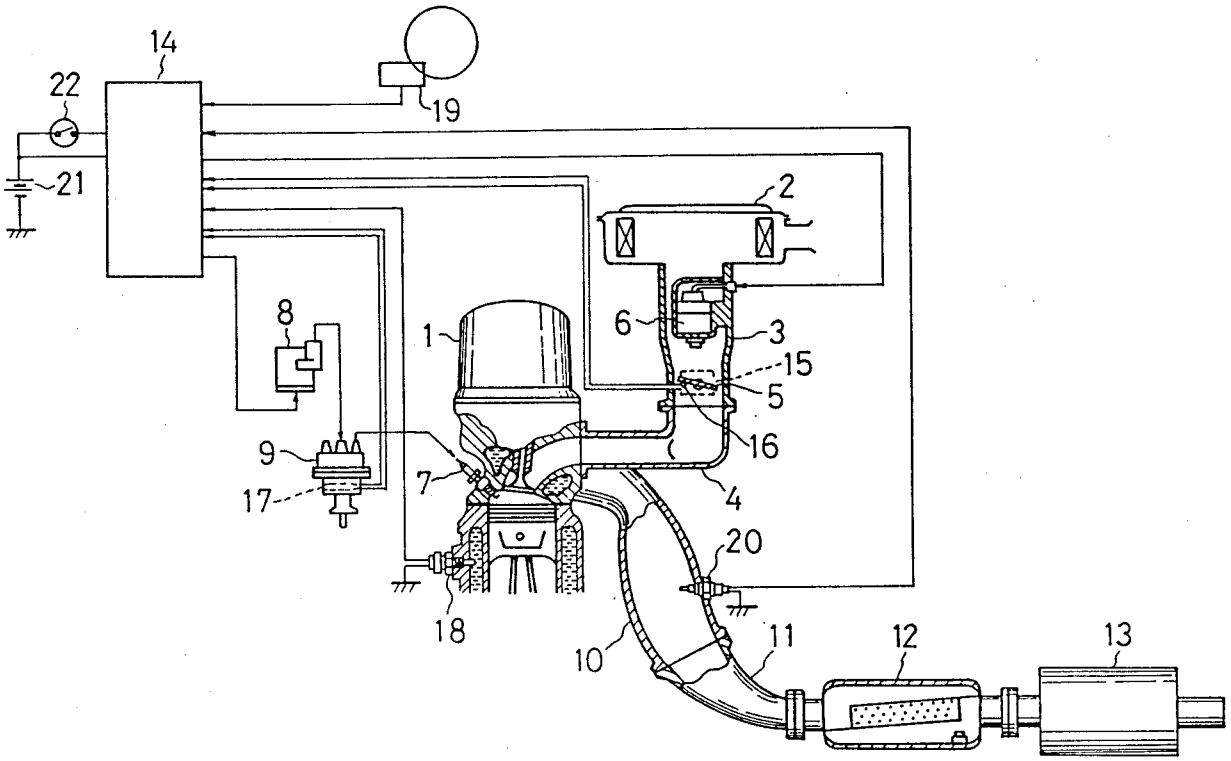
FIG. 2 is a systematic diagram illustrating embodiments of the present invention.

Referring to FIG. 2, air is sucked in an engine 1 from an air cleaner 2 through a throttle body 3 and an intake manifold 4.

A throttle valve 5 co-operative with an accelerator pedal not shown in the drawings is arranged in the throttle body 3. A fuel injection valve 6 as the fuel-injecting means is arranged upstream of the throttle valve 5. The fuel injection valve 6 is an electromagnetic fuel injection valve which is opened on actuation of a solenoid and is closed on de-energization of the solenoid. Namely, the fuel injection valve 6 is opened by actuation by a driving pulse signal from a control unit 14 described hereinafter, and a fuel fed under pressure by a fuel pump not shown in the drawings is injected and supplied under a predetermined pressure adjusted by a pressure regulator. Incidentally, although the single-point injection system is adopted in the present embodiment, there can be adopted a multi-point injection system in which a fuel injection valve is arranged for each of cylinders in the branch portion of the intake manifold or the suction port of the engine.

An ignition plug 7 is arranged in a combustion chamber of the engine 1, and an air-fuel mixture is ignited and burnt by spark ignition by the ignition plug 7 to which a high voltage generated by an ignition coil 8 based on an ignition signal from the control unit 14 is applied through a distributor 9.

An exhaust gas is discharged from the engine 1 through an exhaust manifold 10, an exhaust duct 11, a ternary catalyst 12 and a muffler 13.

The control unit 14 is provided with a micro-computer comprising CPU, ROM, RAM, an A/D converter and an input-output interface, and the control unit 14 receives input signals from various sensors, performs compution processings as described below and controls the operation of the fuel injection valve 6 and the operation of the ignition coil 8 for controlling the ignition timing.

As the various sensors, a potentiometer meter type throttle sensor 15 is arranged on the throttle valve 5 to put out a voltage signal corresponding to the opening degree $\alpha$ of the throttle valve 5, and an idle switch 16 is arranged in the throttle sensor 15 so that the idle switch 16 is turned on when the throttle valve 5 is completely closed.

A crank angle sensor 17 is arranged in the distributor 9 to put out a position signal by every 2° of the crank angle and a reference signal by every 180° of the crank angle (in case of a four-cylinder engine). The revolution number N of the engine can be calculated by measuring the number of pulses of the position signal or the frequency of the reference signal per unit time.

Furthermore, there are disposed a water temperature sensor 18 for detecting the engine-cooling water temperature Tw and a vehicle speed sensor 19 for detecting the vehicle speed VSP.

These sensors such as the throttle sensor 15 and the crank angle sensor 17 constitute the engine driving state-detecting means.

An $O_2$ sensor 20 is arranged as air-fuel ratio detecting means of exhaust gas in the exhaust manifold 10.

Figure 7:
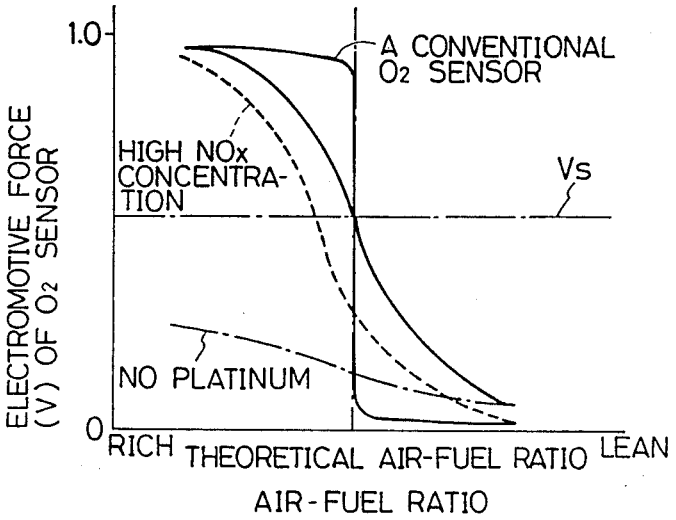
FIG. 7 is a graph illustrating the output characteristic of an $O_2$ sensor used in an embodiment of the present invention.

This $O_2$ sensor 20 comprises, for example, a zirconia tube having platinum electrodes formed on the inner and outer surfaces thereof, in which an electromotive force is generated according to the oxygen concentration ratio between the outer air introduced in the interior of the zirconia tube and the exhaust gas outside the zirconia tube. A platinum catalyst layer acting as an oxidation catalyst is formed on the outer surface of the outer platinum electrode. This platinum catalyst couples $O_2$ present in a small amount on combustion of a rich air-fuel mixture with an unburnt component such as CO to reduce the oxygen concentration on the outside substantially to zero, whereby the oxygen concentration ratio between the outside and inside of the zirconia tube is increased and a large electromotive force is generated. In the present embodiment, however, the catalyzing activity of the platinum catalyst layer of the $O_2$ sensor 20 is weakened. Therefore, it is impossible to reduce the oxygen concentration to zero promptly by smooth reaction of low-concentration oxygen on the outer side of the zirconia tube with unburnt components, and the output value (electromotive force) is gradually changed with the theoretical air-fuel ratio where the oxygen concentration abruptly changes being as the boundary, as shown in FIG. 7.

More specifically, if there is not catalyzing action of platinum, since oxygen is left after combustion of a rich air-fuel mixture, the oxygen concentration ratio between the inside and outside of the zirconia tube is low and a satisfactory electromotive force cannot be obtained. Accordingly, low-concentration oxygen is consumed by the catalyzing action of platinum so as to obtain a large electromotive force. However, the rising of the electromotive force is dulled by weakening the catalyzing action of platinum, and the $O_2$ sensor 20 having an output characteristic as shown in FIG. 7 is thus formed. By using this $O_2$ sensor, not only the on-off judgment of whether the air-fuel ratio is rich or lean as compared with the theoretical air-fuel ratio but also the detection of the deviation of the air-fuel ratio from the theoretical air-fuel ratio while specifying the theoretical air-fuel ratio can be accomplished.

A battery 21 as an operating power source or as a power source voltage-detecting means is connected to the control unit 14 through an ignition key switch 22. As the operation power source of RAM in the control unit 14, a battery 21 is connected through an appropriate stabilizing power source, not through the ignition key switch 22, so as to retain the memory just after the ignition key switch 22 has been turned off.

In the present embodiment, CPU of the micro-computer built in the control unit 14 performs computing processings according to programs (fuel injection quantity-calculating routine, feedback control zone-judging routine and integration control routine) on ROM, shown in flow charts of FIGS. 3 through 6, and controls the injection of the fuel.

Incidentally, the functions of the basic fuel injection quantity-setting means, air-fuel deviation calculation means, air-fuel ratio feedback correction coefficient-setting means, fuel injection quantity-setting means, driving signal output means and integration constant-setting means are exerted according to the above-mentioned programs.

Figure 3:
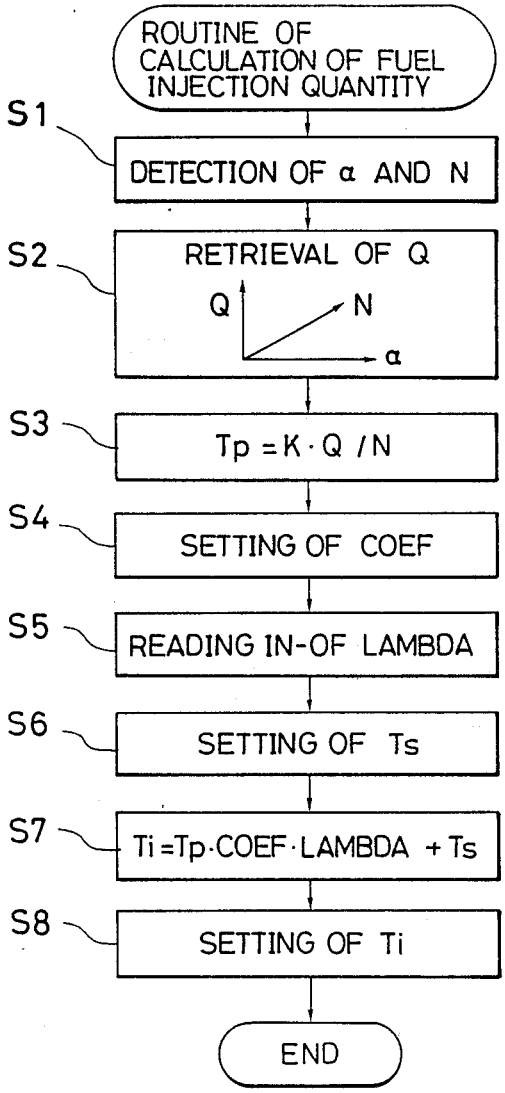
FIGS. 3 and 4 are flow charts showing a common control adopted in the present invention.

In the fuel injection quantity-calculating routine shown in FIG. 3, at step 1 (shown as "S1" in the drawings; the same will apply hereinafter), a throttle valve opening degree $\alpha$ detected based on a signal from the throttle sensor 15 and an engine revolution number N calculated based on a signal from the crank angle sensor 17 are put in.

At step 2, the sucked air flow quantity Q corresponding to the actual throttle valve opening degree $\alpha$ and engine revolution number N are retrieved and put in with reference to a map on ROM, in which the sucked air flow quantity Q determined according to $\alpha$ and N by an experiment or the like is stored.

At step 3, the basic fuel injection quantity $T_p = K \cdot Q/N$ (K is a constant) corresponding to the sucked air flow quantity per unit revolution is calculated from the sucked air flow quantity Q and engine revolution number N. The portion of steps 1 through 3 corresponds to the basic fuel injection quantity-setting means.

At step 4, the correction coefficient COEF including the change ratio of the throttle valve opening degree $\alpha$ detected based on a signal from the throttle sensor 15, the acceleration correction on the on-off changeover of the idle switch 16 and the water temperature correction corresponding to the engine-cooling temperature Tw detected based on a signal from the water temperature sensor 18 is set.

At step 5, the air-fuel ratio feedback correction coefficient LAMBDA set by the integration control routine of FIG. 5 or 6 described hereinafter is put in. Incidentally, the reference value of the air-fuel ratio feedback correction coefficient LAMBDA is 1.

At step 6, the voltage correction Ts is set based on the voltage value of the battery 21. This is to correct the change of the injection quantity (effective valve-opening time) of the fuel-injecting valve caused by the fluctuation of the battery voltage.

At step 7, the fuel injection quantity Ti is calculated according to the formula of $Ti = T_p \cdot COEF \cdot LAMBDA + Ts$, and this portion corresponds to the fuel injection quantity-calculating means.

At step 8, the calculated fuel injection quantity Ti is set in an output register. At a fuel injection timing synchronous with the revolution of the engine (for example, at every ½ revolution), a driving pulse signal having a pulse width Ti is given to the fuel-injecting valve 6 to effect injection of the fuel.

Figure 4:
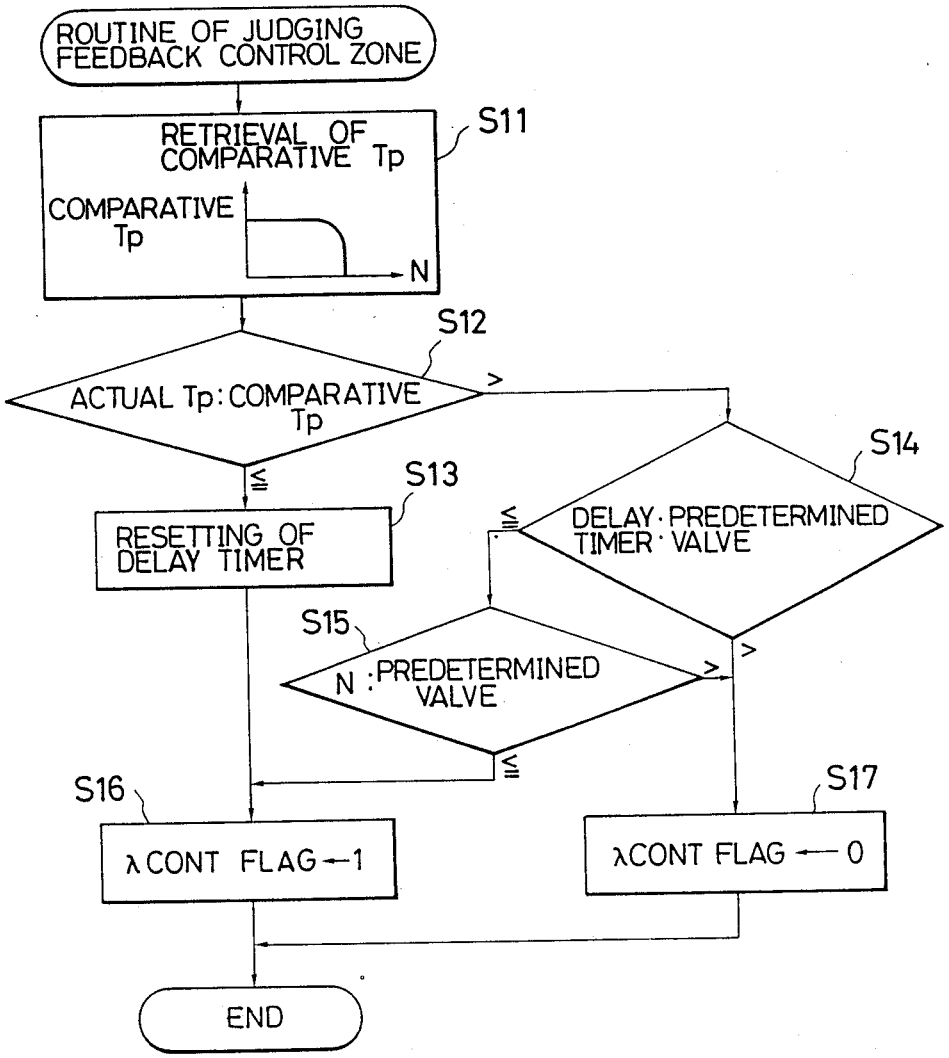

FIG. 4 shows the routine of judging the air-fuel ratio feedback control zone, which is in principle arranged to perform the feedback control of the air-fuel ratio under a low or medium revolution and a low or medium load and stop the feedback control of the air-fuel ratio under a high revolution and a high load.

At step 11, comparative $T_p$ is retrieved from the engine revolution number N, and at step 12, the actual fuel injection quantity $T_p$ (actual $T_p$) is compared with comparative $T_p$.

In case of actual $T_p \leqq$ comparative $T_p$, namely under a low or medium revolution and a low or medium load, the routine goes into step 13, and delay timer (the timer counts up on receipt of a clock signal) is reset. Then, the routine goes into step 16 and $\lambda$cont flag is set at 1. This is for performing the feedback control of the air-fuel ratio under a low or medium revolution and a low or medium load.

In case of actual $T_p >$ comparative $T_p$, that is, under a high revolution or a high load, in principle, the routine goes into step 17 and $\lambda$cont flag is set at 0. This is for stopping the feedback control of the air-fuel ratio and obtaining a rich air-fuel ratio separately to control elevation of the exhaust temperature and prevent the seizure of the engine or burning of the catalyst 12.

Incidentally, even under a high revolution or a high load, at step 14, the value of the delay timer is compared with a predetermined value, and at step 16, $\lambda$cont flag is maintained at 1 to continue the feedback control of the air-fuel ratio until a predetermined time passes from the point of transfer to the high revolution or high load. However, if it is judged at step 15 that the engine revolution number N exceeds a predetermined value (for example, 3800 rpm), the feedback control of the air-fuel ratio is stopped for the safety.

Figure 5:
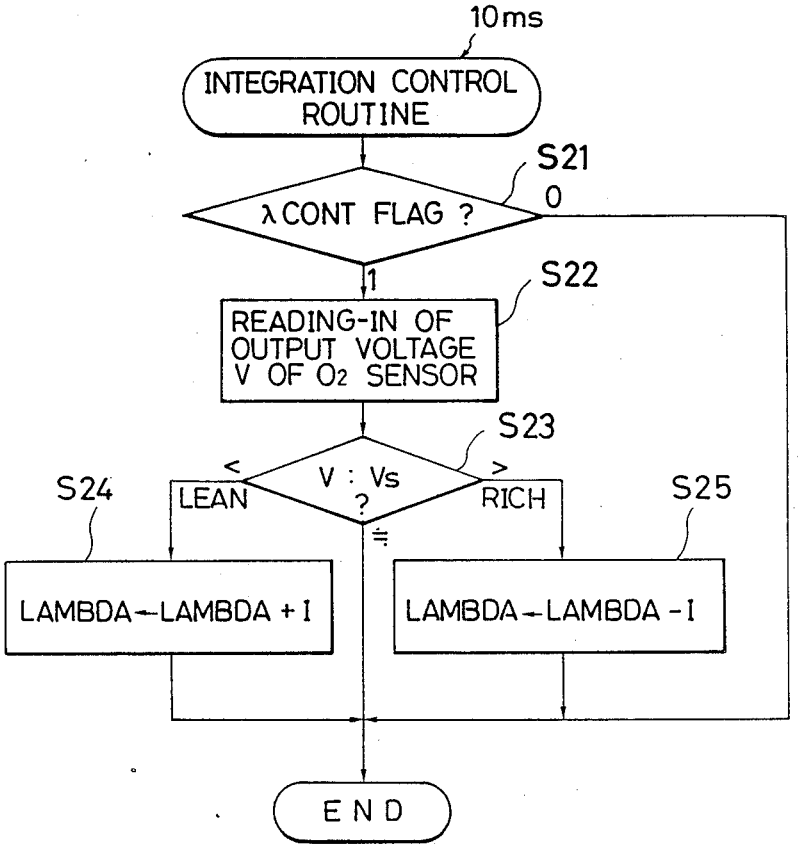
FIG. 5 is a flow chart of the integration control routine according to an embodiment of the first aspect of the present invention.
Figure 6:
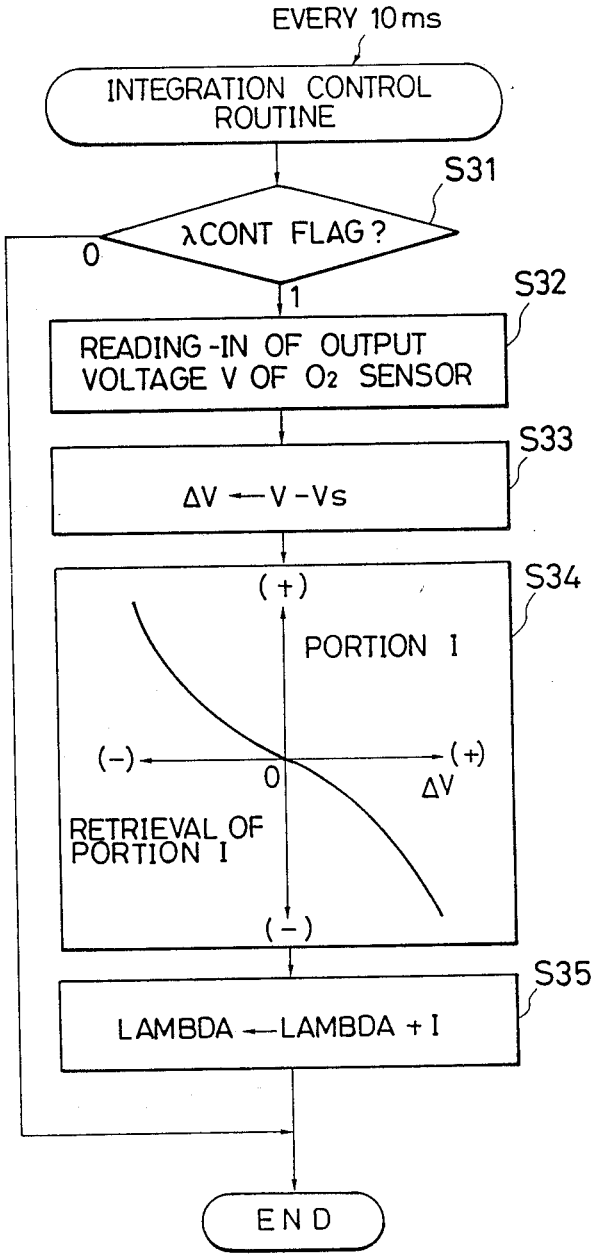
FIG. 6 is a flow chart showing the integration control routine according to an embodiment of the second aspect of the present invention.

FIG. 5 shows the integration control routine according to an embodiment of the first aspect of the present invention. This routine is worked at every predetermined time interval (for example, 10 ms) to set the air-fuel ratio feedback correction coefficient LAMBDA.

Accordingly, this routine corresponds to the air-fuel ratio feedback correction coefficient-setting means.

At step 21, the value of αcont flag is judged, and if this value is 0, the routine ends. In this case, the air-fuel ratio feedback correction coefficient is clamped at the preceding value (or the reference value of 1) and the feedback control of the air-fuel ratio is stopped.

If the value of λcont flag is 1, the routine goes into step 22, and the output voltage V of the $O_2$ sensor 22 is put in and this output voltage V of the $O_2$ sensor is compared with the slice level voltage Vs corresponding to the theoretical air-fuel ratio. If it is judged that V is smaller than Vs and the air-fuel ratio is leaner than the theoretical air-fuel ratio, that is, the target air-fuel ratio, the routine goes into step 24 and the present air-fuel ratio feedback correction coefficient LAMBDA is set at a level attained by adding certain integration constant (portion I) to the precedent air-fuel ratio feedback correction coefficient LAMBDA. On the other hand, if it is judged that V is larger than Vs and the air-fuel ratio is richer than the theoretical air-fuel ratio, that is, the target air-fuel ratio, the routine goes into step 25, and the present air-fuel ratio is set at a level attained by subtracting a certain integration constant (portion I) from the precedent air-fuel ratio feedback correction coefficient LAMBDA. If it is judged that V is nearly equal to Vs and the air-fuel ratio is almost the theoretical air-fuel ratio, this routine ends and the precedent air-fuel ratio feedback correction coefficient LAMBDA is directly used.

Figure 8:
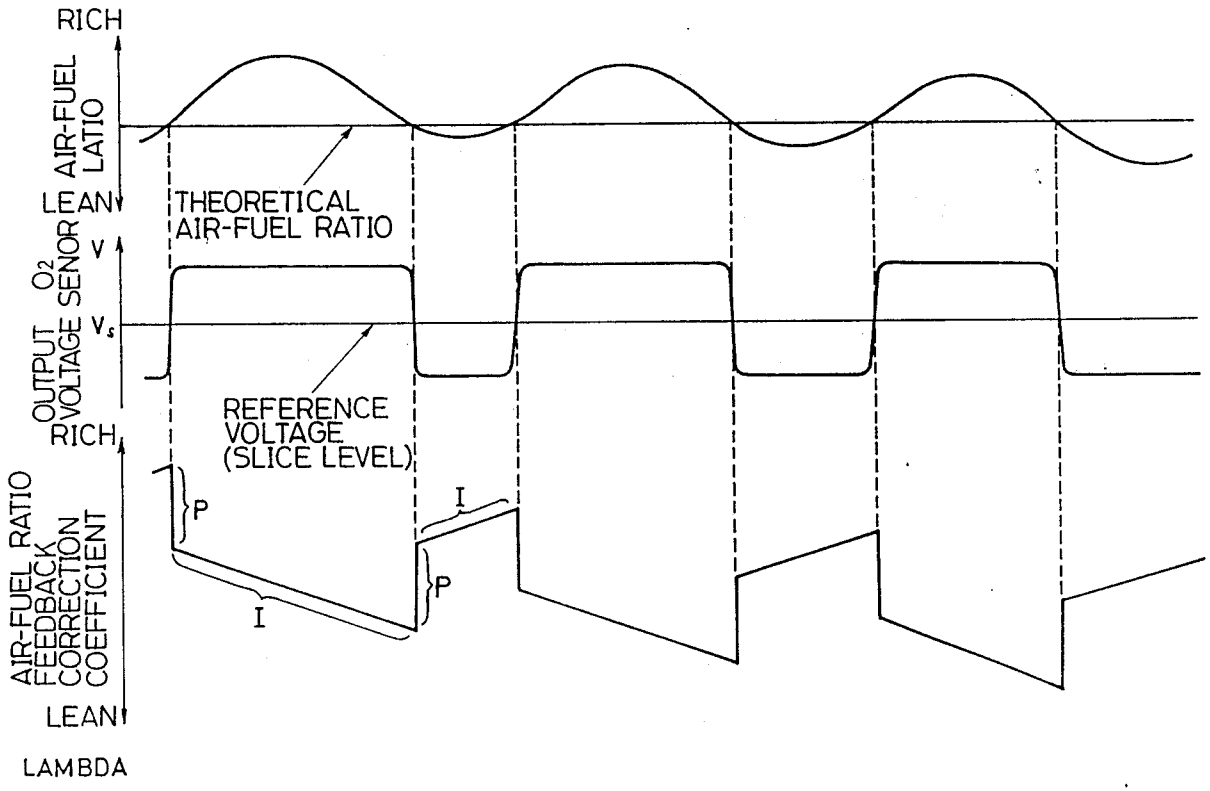
FIG. 8 is a time chart illustrating the conventional feedback control of the air-fuel ratio.

If the $O_2$ sensor 20 in which the output is gradually changed with the theoretical air-fuel ratio being as the boundary is thus used to change the air-fuel ratio feedback correction coefficient LAMBDA and control the air-fuel ratio to the theoretical air-fuel ratio, the theoretical air-fuel ratio can be specified by the electromotive force from the $O_2$ sensor (it is judged that the air-fuel ratio is substantially equal to the theoretical air-fuel ratio and even a slight deviation can be reflected on setting of the air-fuel ratio feedback correction coefficient LAMBDA). Therefore, it may not be necessary to maintain the response characteristic by changing the air-fuel ratio feedback correction coefficient by the proportion (P) control (see FIG. 8) but the air-fuel ratio feedback correction coefficient LAMBDA can be changed only by the integration (I) control.

Figure 9:
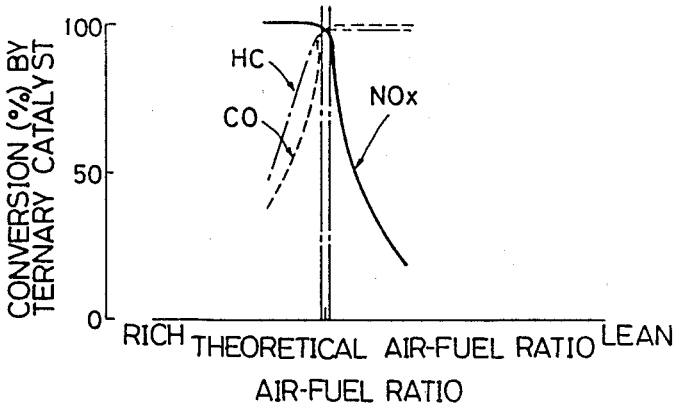
FIG. 9 is a graph illustrating the relation between the conversion by the ternary catalyst and the air-fuel ratio.

Therefore, the air-fuel ratio feedback correction coefficient LAMBDA can be gradually changed (increase or decrease only by the certain integration constant and no increase or decrease by the proportion control), and the width of the change of the air-fuel ratio by the feedback control of the air-fuel ratio can be reduced stably, with the result that the horizontal vibration (surge) of the vehicle can be prevented and a good exhaust gas-purging action by the ternary catalyst can be maintained (see FIG. 9).

Figure 10:
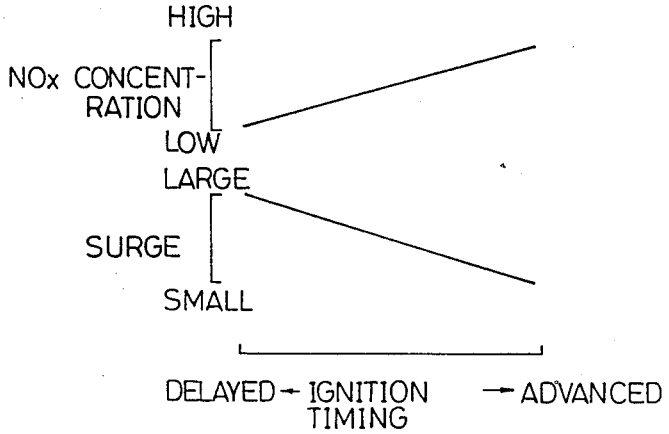
FIG. 10 is a graph illustrating the influences of the ignition timing on the surge and $NO_x$ concentration.

If the surge is thus prevented, it becomes unnecessary to prevent the surge by advancing the ignition timing unnecessarily, and by lowering of the combustion temperature by this delay of the ignition timing, increase of nitrogen oxides $NO_x$ can be controlled (see FIG. 10).

The integration control routine according to an embodiment of the second aspect of the present invention will now be described with reference to the flow chart of FIG. 6 and the general block diagram of FIG. 11. Incidentally, this routine is worked at every predetermined time interval (for example, 10 ms) as the integration control routine shown in FIG. 5.

At step 31, the value of λcont flag is judged, and if this value is 0, the routine ends. In this case, the air-fuel ratio feedback correction coefficient LAMBDA is clamped at the precedent value (or the reference value of 1) and the feedback control of the air-fuel ratio is stopped.

In the case where the value of λcont flag is 1, the routine goes into step 32, and the output voltage V of the $O_2$ sensor 20 is put in, and at step 33, which shows air-fuel ratio deviation calculating means, the deviation ΔV is calculated by subtracting the slice level voltage Vs corresponding to the theoretical air-fuel ratio from the output voltage V of the $O_2$ sensor. Namely, the $O_2$ sensor 20 in the present embodiment has such a characteristic that the electromotive force is gradually changed with the theoretical air-fuel ratio being as the boundary, as shown in FIG. 6. Accordingly, the deviation between the slice level voltage Vs corresponding to the theoretical air-fuel ratio and the electromotive force V represents the deviation of the actual air-fuel ratio from the theoretical air-fuel ratio.

At step 34, the corresponding integration constant (portion I) based on the result of the calculation at step 33 is retrieved from a map where the integration constant (portion I) of the integration control is set according to the deviation ΔV. As shown in the graph in the flow chart, as the deviation ΔV is larger, a larger value is set for the integration constant (portion I). Accordingly, in the case where the actual air-fuel ratio deviates greatly from the theoretical air-fuel ratio, that is, the target air-fuel ratio, the basic fuel injection quantity $T_p$ is increased or decreased and corrected by a large integration constant (portion I) to bring the air-fuel ratio close to the theoretical air-fuel ratio promptly. On the other hand, in the case where the actual air-fuel ratio is close to the theoretical air-fuel ratio, a small integration constant (portion I) is adopted to reduce the control width and stabilize the air-fuel ratio in the vicinity of the theoretical air-fuel ratio.

At step 35, the present air-fuel ratio feedback correction coefficient LAMBDA is set by adding the integration constant (portion I) retrieved at step 34 to the precedent air-fuel ratio feedback correction coefficient LAMBDA (subtraction in the case where the set portion I is a negative value). Namely, in the present embodiment, the air-fuel ratio correction coefficient is changed only by the integration control, and if the actual air-fuel ratio is excessively richer or leaner than the theoretical air-fuel ratio, that is, the aimed air-fuel ratio, the air-fuel ratio feedback correction coefficient LAMBDA changes with a large gradient, and as the air-fuel ratio becomes close to the theoretical air-fuel ratio, the air-fuel ratio feedback correction coefficient LAMBDA changes with a small gradient (inclusive of a gradient of zero), whereby the air-fuel ratio is controlled to the theoretical air-fuel ratio. These steps 35 and 36 represents integration constant setting means.

If the air-fuel ratio feedback correction coefficient LAMBDA is set and the air-fuel ratio is controlled according to the above-mentioned routine, the same effects as attained in the integration control routine shown in FIG. 5 according to the embodiment of the first aspect of the present invention can be similarly attained. Furthermore, since the integration constant is set according to the deviation between the electromotive force from the $O_2$ sensor and the voltage value corresponding to the theoretical air-fuel ratio, the convergence to the theoretical air-fuel ratio can be increased and the actual air-fuel ratio can be more stably maintained in the vicinity of the theoretical air-fuel ratio, that is, the aimed air-fuel ratio.

Figure 1:
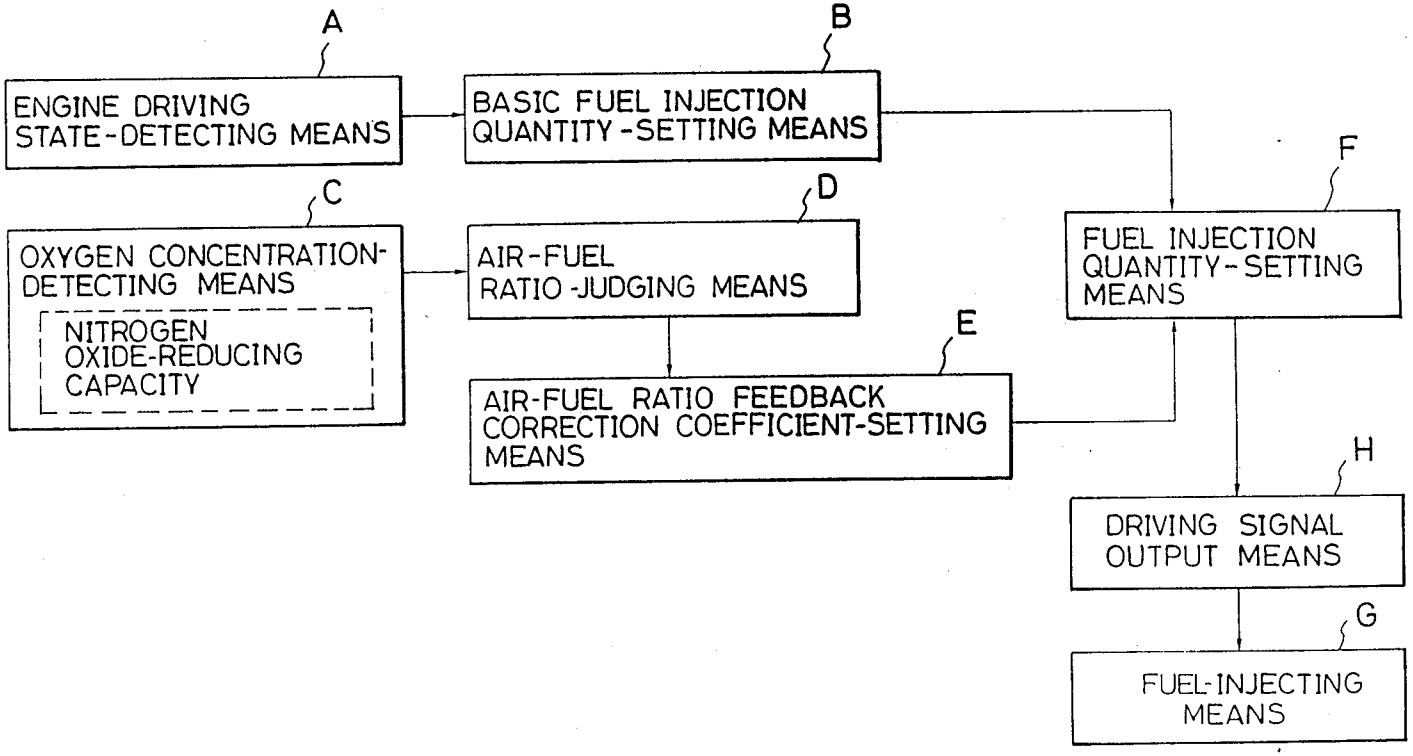
FIG. 1 is a functional block diagram illustrating a first aspect of the present invention.
Figure 11:
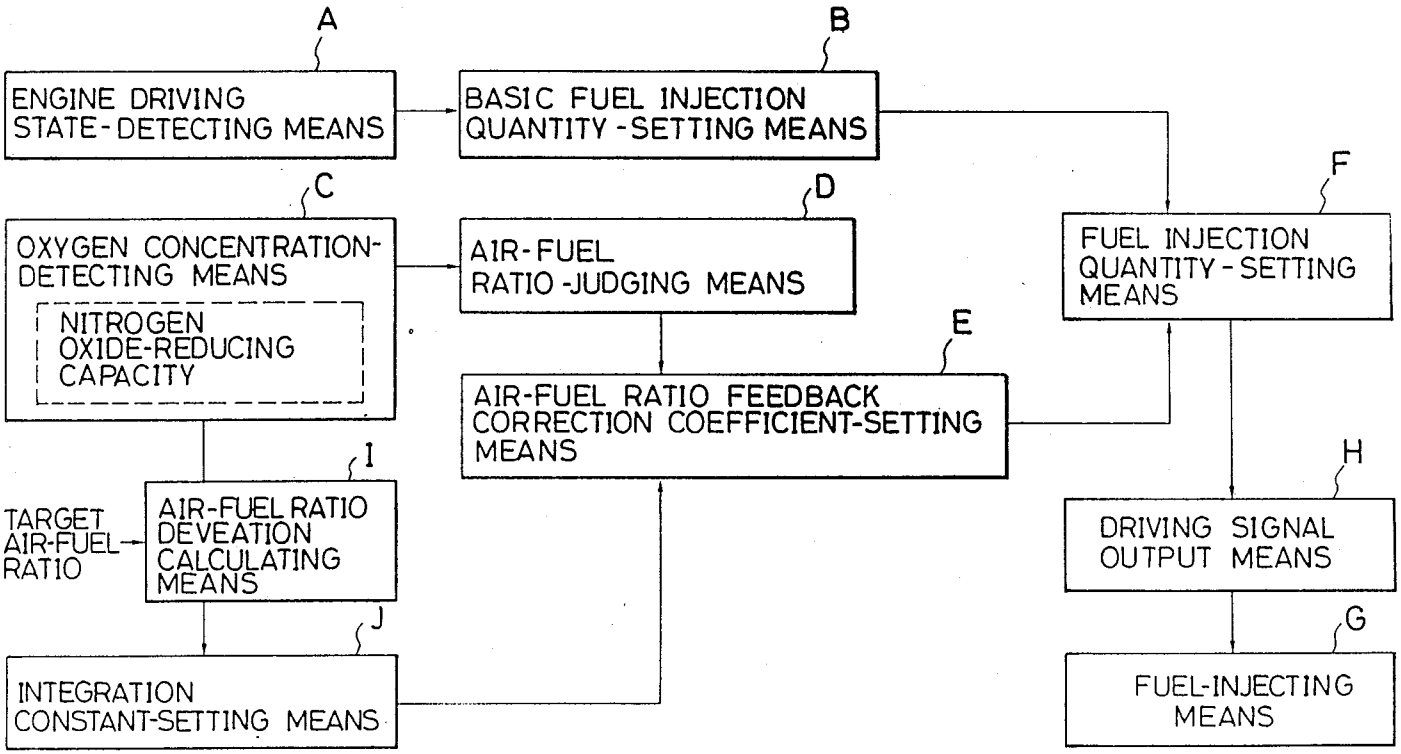
FIG. 11 is a functional block diagram illustrating another aspect of the present invention.

If a nitrogen oxide-reducing capacity is given to the $O_2$ sensor 20 according to another aspect of the present invention shown in FIGS. 1 and 11, when the nitrogen oxide $NO_x$ concentration in the exhaust gas is high, this high-concentration $NO_x$ is reduced to form $O_2$, and therefore, the concentration of oxygen inclusive of this oxygen formed by the reduction of $NO_x$ is detected. Accordingly, even on combustion of a lean air-fuel mixture inherently giving a low oxygen concentration, because of the presence of oxygen formed by the reduction, the output characteristic of the $O_2$ sensor 20 is shifted to a low level, namely the lean side, as shown in FIG. 7.

If the output characteristic of the $O_2$ sensor 20 is thus shifted to the lean side, by performing the feedback control of the air-fuel ratio according to the electromotive force of the $O_2$ sensor, the air-fuel ratio is controlled to a level richer than the theoretical air-fuel ratio. Since the concentration of the nitrogen oxide $NO_x$ is reduced if the air-fuel ratio is richer than the theoretical air-fuel ratio, reduction of the nitrogen oxide $NO_x$ concentration can be attained by this rich-side control. Moreover, if the nitrogen oxide-reducing capacity is given to the $O_2$ sensor 20 having such a characteristic that the output is gradually changed with the theoretical air-fuel ratio being as the boundary, as pointed out above, the air-fuel ratio can be stably controlled to the theoretical air-fuel ratio, that is, the aimed air-fuel ratio, and the reduction of the nitrogen oxide $NO_x$ concentration can be efficiently attained.

The nitrogen oxide-reducing capacity can be imparted, for example, by forming a catalyst layer containing a nitrogen oxide-reducing catalyst such as rhodium Rh or ruthenium Ru on the outer surface of the zirconium tube.

As is apparent from the foregoing description, according to the present invention, since the air-fuel ratio is gradually changed by the feedback control and the air-fuel ratio is stably controlled in the vicinity of the theoretical air-fuel ratio, that is, the aimed air-fuel ratio, occurrence of a horizontal vibration (surge) of a vehicle can be prevented, and the efficiency of purging the exhaust gas by a ternary catalyst can be increased. Furthermore, since occurrence of the surge can be prevented, the ignition timing can be delayed to such an extent that the nitrogen oxide concentration does not exceed a predetermined level, and therefore, increase of the nitrogen oxide concentration can be prevented.

Figure 12:
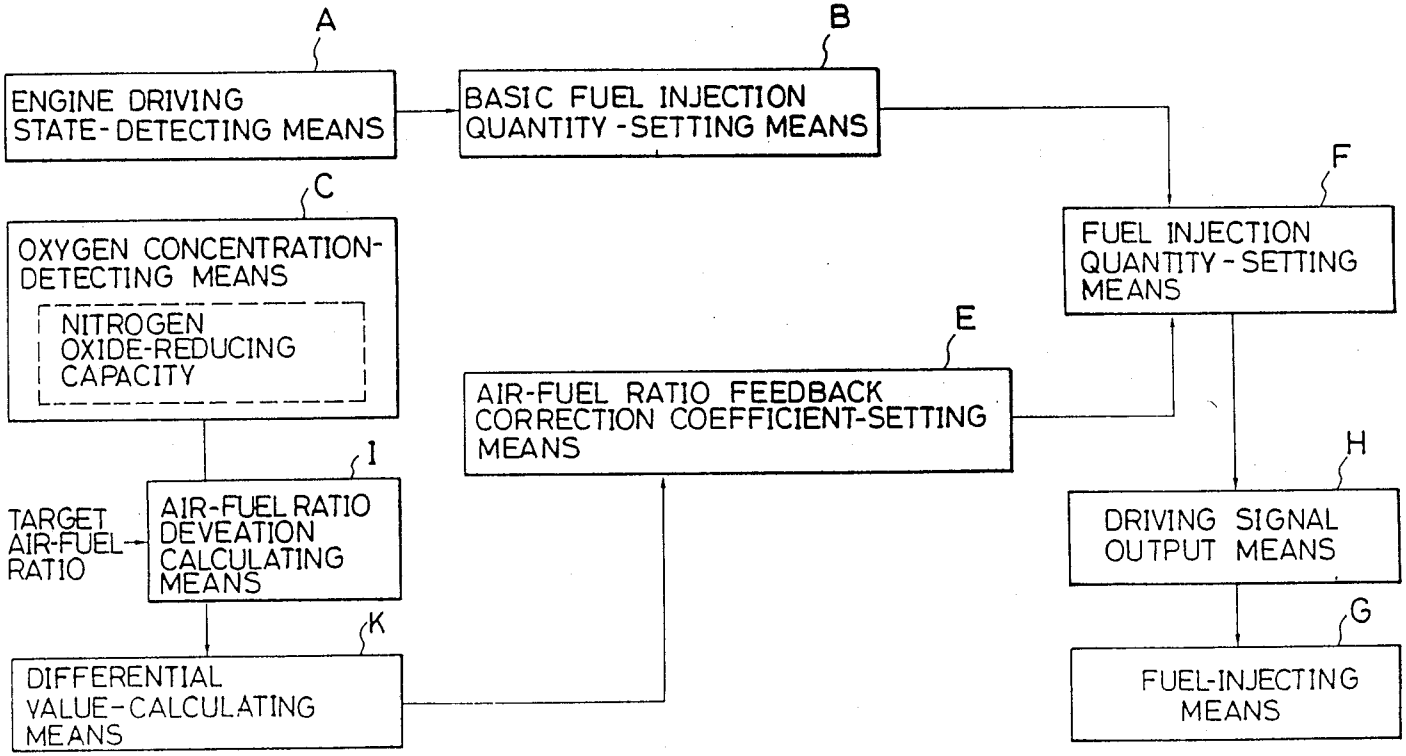
FIG. 12 is a functional block diagram illustrating a further aspect of the present invention.

The other aspect of the present invention will now be described. The embodiment of the aspect is characterized in that the air-fuel ratio feedback correction coefficient is set based on the air-fuel ratio deviation from the slice level and a differential value of the change of the air-fuel ratio as shown in FIG. 12.

The oxygen sensor 20 may be a tube-type sensor in the present embodiment which is an oxygen ion conductor used as the solid electrolyte for a concentration cell, and in this oxygen sensor, an electromotive force corresponding to the oxygen concentration ratio between the outer air in the interior of the zirconia tube and the exhaust gas on the outside of the zirconia tube is generated. There is known an oxygen sensor of this type in which a platinum catalyst layer is formed on the outer surface of a zirconia tube by vacuum deposition of platinum acting as an oxidation catalyst, $O_2$ present in a minute amount on combustion of a rich air-fuel mixture is coupled with an unburnt component such as CO to reduce the oxygen concentration on the outer side substantially to zero and the above-mentioned oxygen concentration ratio is thus increased to generate a large electromotive force.

In the present embodiment, however, the platinum catalyst is semi-catalyzed by annealing the platinum catalyst layer or increasing the particle size of platinum, as taught in Japanese Unexamined Patent Publication No. 59-109853.

Accordingly, low-concentration oxygen on the outside of the tube appropriately reacts with the unburnt component so that the oxygen concentration is not promptly reduced to zero and the electromotive force is changed gradually as a whole though this change is caused with the theoretical air-fuel ratio, where the oxygen concentration abruptly changes, being as the boundary (the characteristic indicated in FIG. 7).

More specifically, if there is no catalytic action of platinum, because of oxygen left after combustion of a rich air-fuel mixture, the oxygen concentration ratio between the outside and inside of the zirconia tube is reduced and a sufficient electromotive force cannot be obtained. Accordingly, low-concentration oxygen is consumed by the catalytic action of platinum to obtain a large electromotive force. By weakening the catalytic action, the rising of the electromotive force is dulled, whereby an oxygen sensor having an inclined output characteristic shown by the solid line in FIG. 7 can be constructed.

By using this oxygen sensor, not only on-off detection of whether the air-fuel ratio is rich or lean as compared with the theoretical air-fuel ratio but also detection of a specific air-fuel ratio can be performed.

Figure 13:
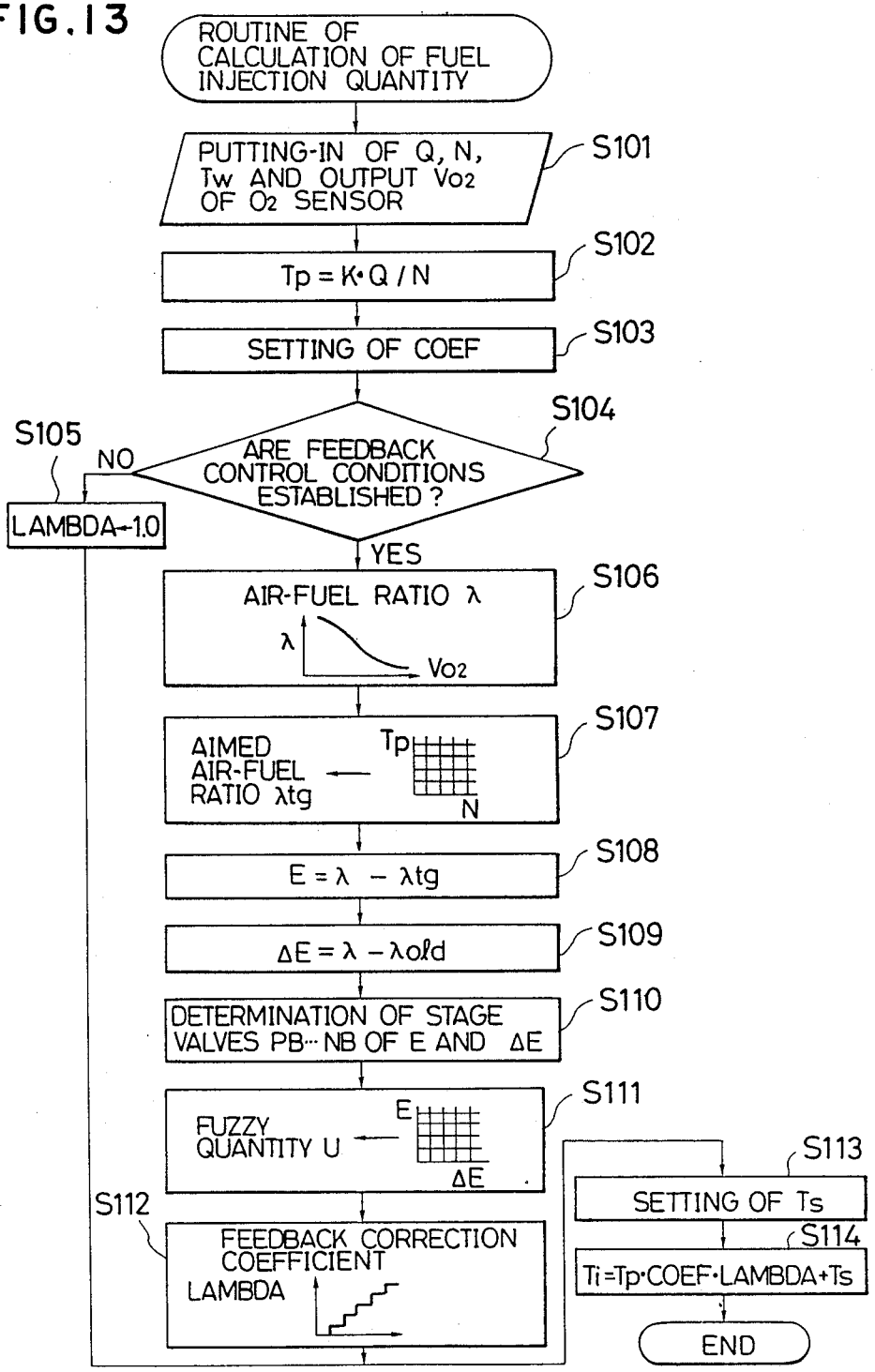
FIG. 13 is a flow chart showing the routine of calculation of the fuel injection quantity according to the present invention shown in FIG. 12.

In the present embodiment of the present invention, CPU of the micro-computer built in the control unit 14 performs computing processing according to a program (fuel injection quantity-calculating routine) on ROM, shown as a flow chart in FIG. 13, and controls the injection of the fuel.

Incidentally, the functions including deviation-calculating means and differential value-calculating means, feedback correction coefficient-setting means are also exerted according to the above-mentioned program.

The computing processing of the microcomputer in the control unit 14 will now be described with reference to the flow chart of FIG. 13.

This fuel injection quantity-calculating routine is worked synchronously with the revolution of the engine or at every predetermined time interval.

At step 101, the sucked air flow quantity Q detected based on the signal from an air flow meter not shown in the drawing and arranged in the intake manifold, the engine revolution number N detected based on the signal from the crank angle sensor 17 and the water temperature Tw detected based on the signal from the water temperature sensor 18 are put in. Furthermore, the output voltage Vo2 of the oxygen sensor 20 is put in.

At step 102, the basic fuel injection quantity $T_p = K \cdot Q/N$ (N is a constant) corresponding to the quantity of air sucked per unit revolution is calculated from the sucked air quantity Q and the engine revolution number N. The portion of this step 2 corresponds to the basic fuel injection quantity-setting means.

At step 103, the correction coefficient CO-EF=1+KTw+ . . . .

At step 104, it is judged whether or not predetermined air-fuel ratio feedback control conditions are established. The air-fuel ratio feedback control conditions are such that the water temperature Tw is higher than a predetermined level, and the oxygen sensor 16 is active and normal and the upper and lower peak values of the output voltage Vo2 are, for example, higher than 720 mV and lower than 230 mV, respectively. In the case where these conditions are not satisfied, in order to stop the air-fuel ratio feedback control, the routine goes into step 105 and the feedback correction coefficient LAMBDA is clamped to 1.0 as the reference value.

In the case where the air-fuel ratio feedback control conditions are established, the routine goes into step 106 and the output voltage Vo2 of the oxygen sensor 20 is converted to the air-fuel ratio λ with reference to a map.

Incidentally, in the present embodiment, the output voltage Vo2 of the oxygen sensor 20 is converted to the air-fuel ratio λ for the processing, but it is possible to perform the processing by regarding the output voltage Vo2 per se as the air-fuel ratio.

Then, the routine goes into step 107, and the target air-fuel ratio λ corresponding to the actual engine revolution number N and basic fuel injection quantity $T_p$ as parameters of the engine driving state is retrieved with reference to a map in which a target air-fuel ratio λtg is determined for each area of the engine driving state according to N and $T_p$. Incidentally, the target air-fuel ratio λtp is set at the theoretical air-fuel ratio in the region of a low or medium revolution and a low or medium load and the target air-fuel ratio λtg is set at a rich value in the region of a high revolution or high load.

Then, the routine goes into step 108, the deviation (error quantity) $E=\lambda-\lambda tg$ of the air-fuel ratio λ from the target air-fuel ratio λtg is calculated.

Then, the routine goes into step 109, the precedent air-fuel ratio λotd is subtracted from the present air-fuel ratio λ and the change quantity of the air-fuel ratio per unit revolution or unit time, that is, the differential value (change speed) $\Delta E=\lambda-\lambda otd$ of the air-fuel ratio, is calculated. The portion of this step 109 corresponds to the differential value-calculating means.

Figure 14:
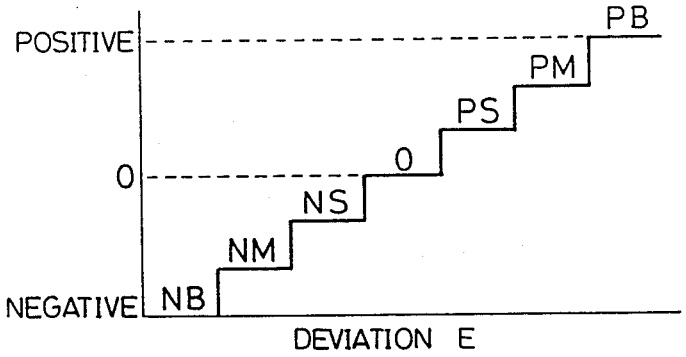
FIGS. 14 through 17 are diagrams showing maps used in the routine shown in FIG. 13.
Figure 15:
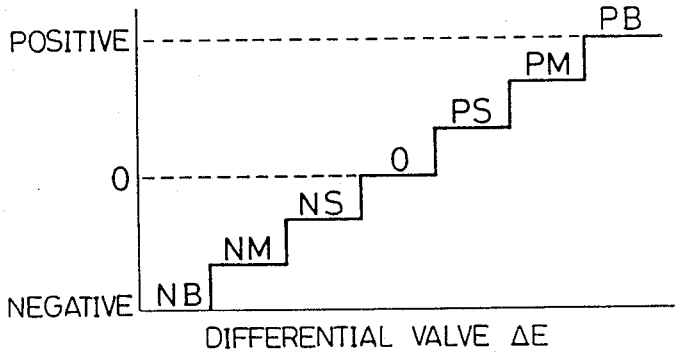

Then, the routine goes into step 110, and the above-mentioned deviation E and differential value ΔE are converted to stage values (fuzzy numbers) with reference to maps shown in FIGS. 14 and 15.

More specifically, the deviation E is converted to one of seven stage values shown in FIG. 14, that is, the positive maximum value PB, the positive intermediate value PM, positive minimum value PS, zero 0, the negative minimum value NS, the negative intermediate value NM and the negative maximum value NB. Furthermore, the differential value ΔE is converted to one of similar seven stage values shown in FIG. 15.

Figures 16, 17:
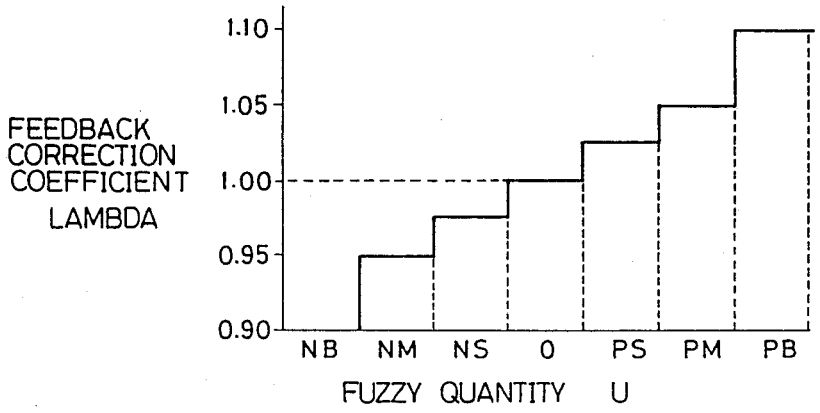

Then, the routine goes into step 111, and the stage value (fuzzy quantity U) of the feedback correction coefficient LAMBDA is set with reference to a map of FIG. 16 where stage values (fuzzy quantities U) of the feedback correction coefficient LAMBDA are determined according to the respective stage values of the above-mentioned deviation E and differential value ΔE.

At this step, the so-called fuzzy reasoning is applied to the setting of the feedback correction coefficient, and the fuzzy quantity U is calculated.

In brief, according to this fuzzy reasoning, in view of the probability (fuzzy quantity) of the proposition to make the operation quantity (control quantity) positive or negative to the input quantity (detected value), the operation quantity is set by weighting this fuzzy quantity.

As the method for setting the fuzzy quantity, there can be mentioned a complicated method in which a fuzzy quantity is set for each of one-stage difference and two-stage difference of the control deviation and the fuzzy quantity is set-theoretically determined from the respective fuzzy quantities. In the present embodiment, as shown in FIG. 16, the fuzzy quantity U is set according to a relatively simple method in which the differential value ΔE is weighted in view of the deviation E.

More specifically, in the case where the differential value ΔE corresponding to the change speed of the air-fuel ratio is a positive large value, that is, in the case where the change of the air-fuel ratio to the rich direction, in order to control excessive enrichment of the air-fuel ratio by overshooting, the feedback correction coefficient LAMBDA should be reduced for controlling the air-fuel ratio to the lean direction. Incidentally, in the case where the differential value ΔE is a positive large value, when the deviation E of the air-fuel ratio from the aimed air-fuel ratio is a positive large value, that is, the air-fuel ratio is rich, the feedback correction coefficient LAMBDA should be reduced, but when the deviation E is a negative large value, that is, the air-fuel ratio is lean, the feedback correction coefficient should not be so reduced.

Accordingly, the fuzzy quantity U is made to correspond to setting of increase of the feedback correction coefficient LAMBDA for changing the positive value of the fuzzy quantity to the rich direction or setting of decrease of the feedback correction coefficient LAMBDA for changing the negative value of the fuzzy quantity to the lean direction and the magnitude of the absolute value is made to correspond to the probability of performance of the increase setting or the decrease setting. In this case, as ΔE is a positive large value and E is a positive large value, a negative large value is set for the fuzzy quantity, and as ΔE is a negative large value and E is a negative large value, a positive large value is set for the fuzzy quantity U.

As in case of E and ΔE, the fuzzy quantity U is set at one of values of seven stages, that is, from the positive maximum value PB to the negative maximum value.

Then, the routine goes into step 112 and the feedback correction coefficient LAMBDA is set with reference to a map of FIG. 17 where values of the feedback correction coefficient LAMBDA are set in correspondence to the respective stage values of the fuzzy quantity U.

More specifically, as shown in FIG. 17, as the fuzzy quantity is a positive value and is larger, the feedback correction coefficient LAMBDA is increased (for example, PB → 1.10, PM → 1.05), and when the fuzzy quantity U is zero, LAMBDA is set at 1.0. As the fuzzy quantity is a negative value and is larger, the feedback correction coefficient is reduced (for example, NB → 0.09, NM → 0.95).

Figure 18:
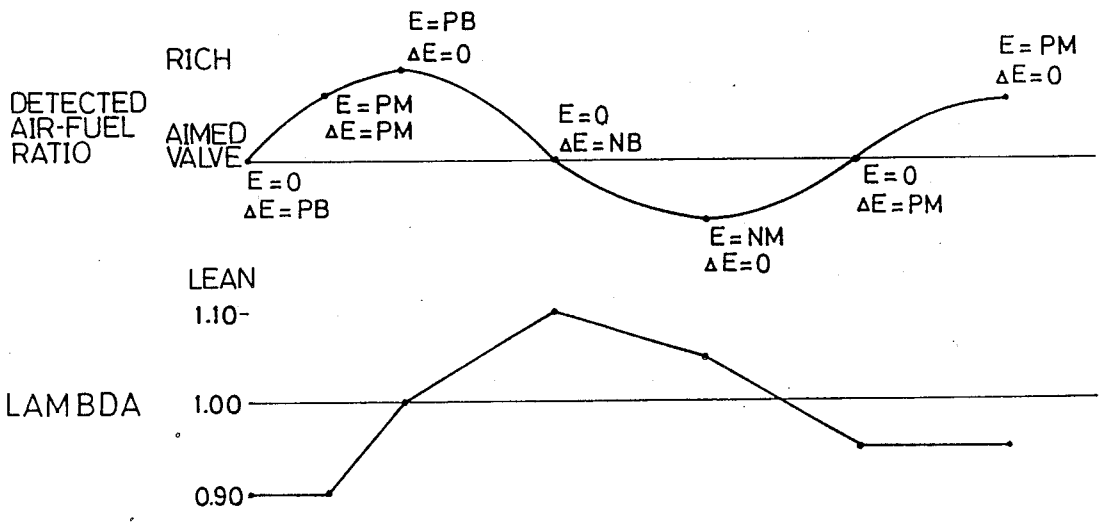
FIG. 18 is a diagram illustrating the manner of setting the feedback correction coefficiency according to the present invention shown in FIG. 12.

Incidentally, FIG. 18 shows the manner of setting the feedback correction coefficient LAMBDA.

The portion of the foregoing steps 110 through 112 corresponds to the feedback correction coefficient-setting means.

After the feedback correction coefficient LAMBDA has been thus set, a voltage correction quantity Ts is set based on the battery voltage at step 113. This is to correct the change of the injection flow rate of the fuel injection valve 6, which is caused by the fluctuation of the battery voltage.

Then, at step 114, the fuel injection quantity Ti is calculated according to the formula of $Ti = T_p \cdot COEF \cdot LAMBDA + Ts$. The portion of this step 114 corresponds to the fuel injection quantity-calculating means.

The so-calculated fuel injection quantity Ti is set at an output register, and at a predetermined fuel injection timing synchronous with the revolution of the engine, a driving pulse signal having a pulse width of most newly set Ti is put out to the fuel injection valve 6 to effect injection of the fuel.

Figure 20:
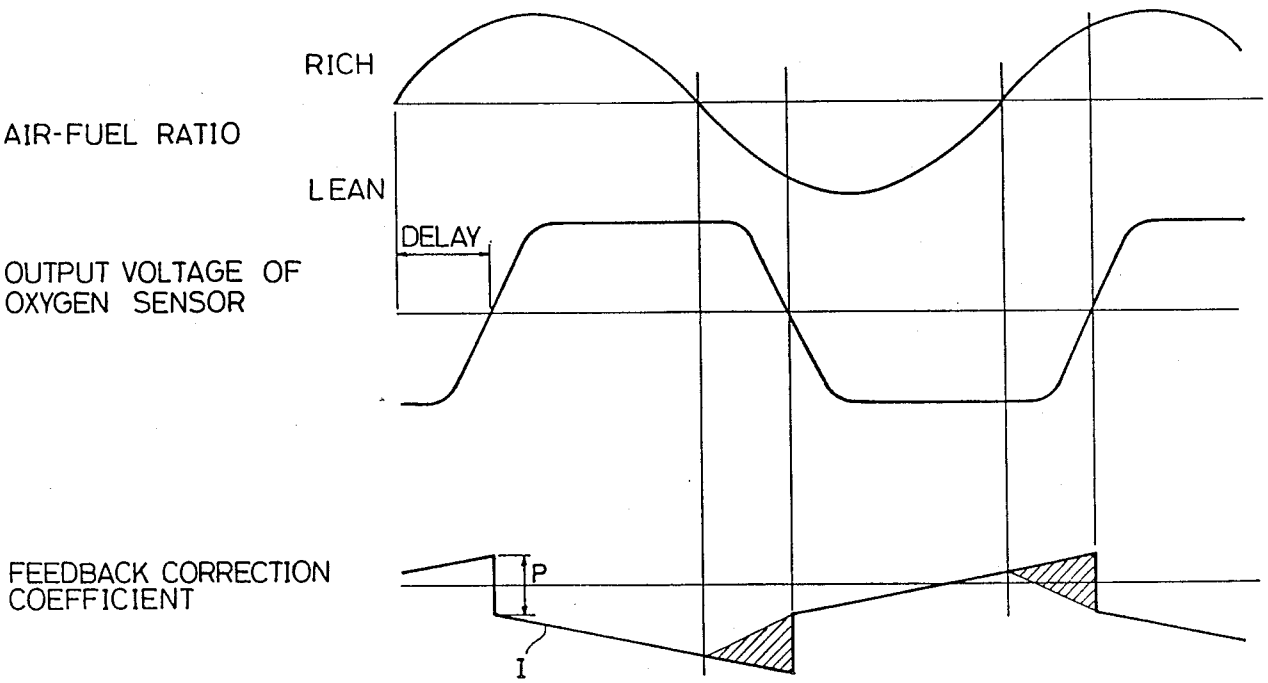
FIG. 20 is a diagram illustrating the manner of setting the feedback correction coefficient in the conventional technique.

In this control of injection of the fuel, since the feedback correction coefficient LAMBDA for the feedback control of the air-fuel ratio can be set based on the deviation E of the air-fuel ratio from the aimed air-fuel ratio and the differential value (change speed) ΔE of the air-fuel ratio, that is, while estimating the state of the change of the air-fuel ratio, the convergence of the air-fuel ratio to the target air-fuel ratio is improved (undesirably controlled portions which is shown in FIG. 20 in slashed lines are deleted), and hunting by insufficient control can be prevented, the surge torque can be reduced to improve the driving characteristic and the exhaust gas-purging capacity can be increased.

An embodiment in which the oxygen sensor 20 is modified will now be described.

In an inclined oxygen sensor, as proposed in Japanese Patent Application No. 62-65844, a $NO_x$-reducing catalyst comprising a reducing catalyst, such as rhodium (Rh) or ruthenium (Ru), supported on a carrier of titanium oxide ($TiO_2$) or lanthanum oxide ($La_2O_3$) can also be employed as same as described in the preceding embodiment.

Figure 19:
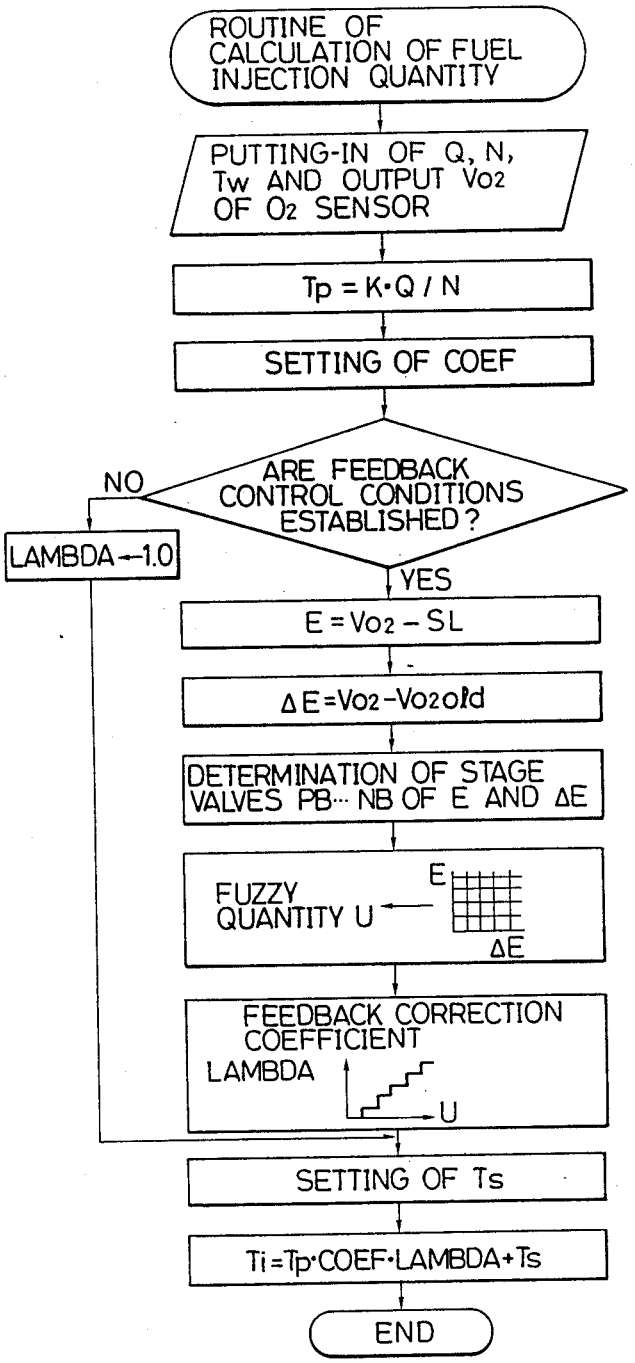
FIG. 19 is a flow chart showing the routine of calculation of the fuel injection quantity according to another embodiment of the present invention.

FIG. 19 illustrates the routine of the calculation of the fuel injection quantity adopted when the on-off oxygen sensor or the on-off oxygen sensor to which the $NO_x$-reducing catalyst layer is added is used.

This routine is different from the above-mentioned routine in that the deviation E is determined by subtracting a slice level voltage SL (for example, 500 mV) from the output voltage Vo2 of the oxygen sensor and the differential value ΔE is determined by subtracting the preceding output voltage Vo2otd from the present output voltage Vo2.

As is apparent from the foregoing description, according to the present invention, by performing the feedback control while estimating the change of the air-fuel ratio, the convergence to the target air-fuel ratio can be increased and the driving characteristic can be improved by reduction of the surge torque. Furthermore, there can be attained an effect of improving the exhaust gas-purging capacity.

We claim:

1. An electric air-fuel ratio control apparatus for use in an internal combustion engine, which comprises:

an engine driving state-detecting means for detecting the driving state of the engine;

a basic fuel injection quantity-setting means for setting a basic fuel injection quantity based on the engine driving state detected by the engine driving state-detecting means;

an oxygen concentration-detecting means for detecting an oxygen concentration in an exhaust gas, which has such an output characteristic that the output value gradually changes with the oxygen concentration in a zone in the vicinity of the theoretical air-fuel ratio of an air-fuel mixture sucked in the engine, wherein said oxygen concentration-detecting means comprises a zirconia tube having platinum electrodes formed on an inner surface and an outer surface thereof, in which an electromotive force is generated according to the oxygen concentration ratio between outer air introduced in the interior of the zirconia tube and exhaust gas from the engine outside the tube, said platinum catalyst layer acting as an oxidation catalyst with such a weakened oxidation activity that the output electromotive force of the oxygen concentration-detecting means is gradually changed with an air-fuel ratio in a zone in the vicinity of the theoretical air-fuel ratio, said oxygen concentration-detecting means having a capacity for reducing nitrogen oxides contained in an exhaust gas of the engine, detects the concentration of oxygen in the exhaust gas, inclusive of oxygen obtained by reduction of the nitrogen oxides, and has such an output characteristic that the output value gradually changes with the oxygen in a zone in the vicinity of the theoretical air-fuel ratio of an air-fuel mixture sucked in the engine;

an air-fuel ratio-judging means for comparing the output value of the oxygen concentration-detecting means with a predetermined value corresponding to the theoretical air-fuel ratio and judging the air-fuel ratio of the air-fuel mixture sucked in the engine with reference to the theoretical air-fuel ratio;

an air-fuel ratio feedback correction coefficient-setting means for changing and setting, by integration control based on a predetermined integration constant, an air-fuel ratio feedback correction coefficient for correcting the basic fuel injection quantity based on the result of the judgment of the air-fuel ratio-judging means to bring the actual air-fuel ratio close to the theoretical air-fuel ratio;

a fuel injection quantity-setting means for setting a fuel injection quantity based on the basic fuel injection quantity set by the basic fuel injection quantity-setting means and the air-fuel ratio feedback correction coefficient set by the air-fuel ratio feedback correction coefficient-setting means;

a fuel injection means for injecting fuel into the engine; and a driving signal output means for putting out a driving signal corresponding to the fuel injection quantity set by the fuel injection quantity-setting means to a fuel-injecting means in an on-off manner.

2. An electric air-fuel ratio control apparatus for use in an engine as set forth in claim 1 wherein said basic fuel injection quantity-setting means set a basic fuel injection quantity $T_p$ based on a following formula, $$T_p = K \cdot Q/N$$

where K stands for a constant, Q stands for a quantity of air sucked into the engine and N stands for the speed of the engine.

3. An electric air-fuel ratio control apparatus for use in an engine as set forth in claim 2 wherein the quantity Q of air sucked into the engine is retrieved based on an opening degree of a throttle valve arranged in an intake passage of the engine and the number of the engine revolution, both are detected by said engine driving state-detecting means.

4. An electric air-fuel ratio control apparatus for use in an engine as set forth in claim 2 wherein the quantity Q of air sucked into the engine is a value corresponding to the actually sucked air quantity which is output from an airflow meter as one of said engine driving state-detecting means arranged in an intake passage of the engine.

5. An electric air-fuel ratio control apparatus for use in an engine as set forth in claim 1 wherein said oxygen concentration-detecting means further comprises nitrogen-oxide reducing catalyst layer such as rhodium Rh and ruthenium Ru on the outer surface of the zirconium tube.

6. An electric air-fuel ratio control apparatus for use in an engine as set forth in claim 1, wherein said air-fuel ratio feedback correction coefficient-setting means compares an output value V from said oxygen concentration-detecting means with a slice level Vs corresponding to a target air-fuel ratio and sets the present air-fuel ratio feedback correction coefficient LAMBDA to a level attained by gradually changing the present air-fuel ratio feedback correction coefficient LAMBDA by an integration constant I in response to the air-fuel ratio level with reference to the target air-fuel ratio resulted by the comparison of the output value of said oxygen concentration-detecting means with the slice level.

7. An electric air-fuel ratio control apparatus for use in an engine as set forth in claim 6 wherein said fuel injection quantity-setting means sets a fuel injection quantity Ti based on a following formula, $$T_p = K \cdot Q/N$$

$$Ti = T_p \cdot COEF \cdot LAMBDA + Ts$$

where K stands for a constant, Q stands for a quantity of air sucked into the engine, $T_p$ stands for a basic fuel injection quantity, COEF stands for a correction coefficient set by corresponding a various kinds of engine driving states, LAMBDA stands for an air-fuel ratio feedback correction coefficient and Ts stands for a correction quantity pertaining to a fluction of a battery voltage for the engine.

8. An electric air-fuel ratio control apparatus for use in an internal combustion engine, which comprises:

an engine driving state-detecting means for detecting the driving state of the engine;

a basic fuel injection quantity-setting means for setting a basic fuel injection quantity based on the engine driving state detected by the engine driving state-detecting means;

an oxygen concentration-detecting means for detecting an oxygen concentration in an exhaust gas, which has such an output characteristic that the output value gradually changes with the oxygen concentration in a zone in the vicinity of the theoretical air-fuel ratio of an air-fuel mixture sucked in the engine, wherein said oxygen concentration-detecting means comprises a zirconia tube having platinum electrodes formed on an inner surface and an outer surface thereof, in which an electromotive force is generated according to the oxygen concentration ratio between outer air introduced in the interior of the zirconia tube and exhaust gas from the engine outside the tube, said platinum catalyst layer action as an oxidation catalyst with such a weakened oxidation activity that the output electromotive force of the oxygen concentration-detecting means is gradually changed with an air-fuel ratio in a zone in the vicinity of the theoretical air-fuel ratio; an air-fuel ratio-judging means for comparing the output output value of the oxygen concentration-detecting means with a predetermined value corresponding to the theoretical air-fuel ratio and judging the air-fuel ratio of the air-fuel mixture sucked in the engine with reference to the theoretical air-fuel ratio;

an air-fuel ratio deviation calculating means for determining a deviation of the output value of the oxygen concentration-detecting means from the predetermined output value corresponding to the theoretical air-fuel ratio;

an integration constant-setting means for setting an integration constant for integration control according to said deviation;

an air-fuel ratio feedback correction coefficient-setting means for changing and setting, an air-fuel ratio feedback correction coefficient for correcting the basic fuel injection quantity based on the result of the judgment of the air-fuel ratio-judging means to bring the actual air-fuel ratio close to the theoretical air-fuel ratio by the integration control based on the integration constant set by the integration constant-setting means;

a fuel injection quantity-setting means for setting a fuel injection quantity based on the basic fuel injection quantity set by the basic fuel injection quantity-setting means and the air-fuel ratio feedback correction coefficient set by the air-fuel ratio feedback correction coefficient-setting means;

a fuel injection means for injection fuel into the engine; and a driving signal output means for putting out a driving signal corresponding to the fuel injection quantity set by the fuel injection quantity-setting means to a fuel-injecting means in an on-off manner.

9. An electric air-fuel ratio control apparatus for use in an internal combustion engine as set forth in claim 8 wherein said air-fuel ratio feedback correction coefficient setting means corrects the precedent air-fuel ratio feedback correction coefficient LAMBDA to a level attained by adding or subtracting a certain integration constant I thereto or therefrom, the certain integration constant I being determined by said integration constant-setting means.

10. An electric air-fuel ratio apparatus for use in an engine as set forth in claim 8 wherein said basic fuel injection quantity-setting means set a basic fuel injection quantity $T_p$ based on a following formula, $$T_p = K \cdot Q/N$$

where K stands for a constant, Q stands for a quantity of air sucked into the engine and N stands for the speed of the engine.

11. An air-fuel ratio control apparatus for use in an engine as set forth in claim 10 wherein the quantity Q of air sucked into the engine is retrieved based on an opening degree of a throttle valve arranged in an intake passage of the engine and the number of the engine revolution, both are detected by said engine driving state-detecting means.

12. An electric air-fuel ratio control for use in an engine as set forth in claim 10 wherein the quantity Q of air sucked into the engine is a value corresponding to the actually sucked air quantity which is output from an airflow meter as one of said engine driving state-detecting means arranged in an intake passage of the engine.

13. An air-fuel ratio control apparatus for use in an engine as set forth in claim 8 wherein said oxygen concentration-detecting means has a capacity of reducing nitrogen oxides contained in an exhaust gas of the engine, detects the concentration of oxygen in the exhaust gas, inclusive of oxygen obtained by reduction of the nitrogen oxides, and has such an output characteristic that the output value gradually changes with the oxygen in a zone in the vicinity of the theoretical air-fuel ratio of an air-fuel mixture sucked in the engine.

14. An electric air-fuel ratio control, apparatus for use in an engine as set forth in claim 8 wherein said oxygen concentration-detecting means further comprises nitrogen-oxide reducing catalyst layer such as rhodium Rh and/or ruthenium Ru on the outer surface of the zirconium tube.

15. An electric air-fuel ratio control apparatus for use in an engine as set forth in claim 8 wherein said fuel injection quantity-setting means sets a fuel injection quantity Ti based on a following formula, $$T_p = K \cdot Q/N$$

$$Ti = T_p \cdot COEF \cdot LAMBDA + Ts$$

where K stands for a constant, Q stands for a quantity of air sucked into the engine, $T_p$ stands for a basic fuel injection quantity, COEF stands for a correction coefficient set by corresponding a various kinds of engine driving states, LAMBDA stands for an air-fuel ratio feedback correction coefficient and Ts stands for a correction quantity pertaining to a fluction of a battery voltage for the engine.

16. An electric air-fuel ratio control apparatus for use in an internal combustion engine, which comprises:

an engine driving state-detecting means for detecting the driving state of the engine;

a basic fuel injection quantity-setting means for setting a basic fuel injection quantity based on the engine driving state detected by the engine driving state-detecting means;

an oxygen concentration-detecting means for detecting an oxygen concentration in an exhaust gas, which has such an output characteristic that the output value gradually changes with the oxygen concentration in a zone in the vicinity of the theoretical air-fuel ratio of an air-fuel mixture sucked in the engine, wherein said oxygen concentration-detecting means has a capacity of reducing nitrogen oxides contained in the exhaust gas of the engine, detects the concentration of oxygen in the exhaust gas, inclusive of oxygen obtained by reduction of the nitrogen oxides, and has such an output characteristic that the output value gradually changes with the oxygen in a zone in the vicinity of the theoretical air-fuel ratio of an air-fuel mixture sucked in the engine;

a deviation-calculating means for calculating a deviation of the detected air-fuel ratio from a target air-fuel ratio and judging whether the air-fuel ratio of the air-fuel mixture sucked in the engine is rich or less as compared with the theoretical air-fuel ratio;

a differential value-calculating means for calculating a differential value of the detected air-fuel ratio;

a feedback correction coefficient-setting means for setting a feedback correction coefficient for the feedback correction of the basic fuel injection quantity based on said deviation and said differential value;

a fuel injection quantity-setting means for setting a fuel injection quantity based on the basic fuel injection quantity set by the basic fuel injection quantity-setting means and the air-fuel ratio feedback correction coefficient set by the air-fuel ratio feedback correction coefficient-setting means;

a fuel injecting means for injecting fuel into the engine; and a driving signal output means for putting out a driving signal corresponding to the fuel injection quantity set by the fuel injection quantity-setting means to a fuel-injecting means in an on-off manner.

17. An electric air-fuel ratio control apparatus for use in an engine as set forth in claim 16 wherein said feedback correction coefficient-setting means sets the feedback correction coefficient LAMBDA in correspondence to a respective stage value U for fuzzy control which shows a positive value or a negative value with different levels in stages and which are set based on the deviation of the detected air fuel-ratio from target air-fuel ratio and the differential valve of the detected air-fuel ratio.

18. An electric air-fuel ratio control apparatus for use in an engine as set forth in claim 16 wherein said basic fuel injection quantity-setting means sets a basic fuel injection quantity $T_p$ based on a following formula, $$T_p = K \cdot Q/N$$

where K stands for a constant, Q stands for a quantity of air sucked into the engine and N stands for the speed of the engine.

19. An electric air-fuel ratio control apparatus for use in an engine as set forth in claim 18 wherein the quantity Q of air sucked into the engine is retrieved from a memory based on a throttle opening degree of a throttle valve arranged in an intake passage of the engine and the number of the engine revolution, both are detected by said engine driving state-detecting means.

20. An electric air-fuel ratio control apparatus for use in an engine as set forth in claim 18 wherein the quantity Q of air sucked into the engine is a value corresponding to the actual sucked air quantity which is output from an airflow meter as one of said engine driving state-detecting means arranged in an intake passage of the engine.

21. An electric air-fuel ratio control apparatus for use in an engine as set forth in claim 16 wherein said oxygen concentration-detecting means comprises a zirconia tube having platinum electrodes formed on an inner surface and an outer surface thereof, in which an electromotive force is generated according to the oxygen concentration ratio between an outer air introduced in an interior of the zirconia tube and an exhaust gas from the engine outside the tube, said platinum catalyst layer acting as an oxidation catalyst with such a weakened activity that the output electromotive force of the oxygen concentration-detecting means is gradually changed with an air-fuel ratio in the vicinity of the theoretical air-fuel ratio.

22. An electric air-fuel ratio control apparatus for use in an engine as set forth in claim 21 wherein said oxygen concentration-detecting means further comprises nitrogen-oxide reducing catalyst layer such as rhodium Rh and ruthenium Ru on the outer surface of the zirconium tube.

23. An electric air-fuel ratio control apparatus for use in an engine as set forth in claim 16 wherein said fuel injection quantity-setting means sets a fuel injection quantity Ti based on a following formula, $$T_p = K \cdot Q/N$$

$$Ti = T_p \cdot COEF \cdot LAMBDA + Ts$$

where K stands for a constant, Q stands for a quantity of air sucked into the engine, $T_p$ stands for a basic fuel injection quantity, COEF stands for a correction coefficient set by corresponding a various kinds of engine driving states, LAMBDA stands for an air-fuel ratio feedback correction coefficient and Ts stands for a correction quantity pertaining to a fluction of a battery voltage for the engine.

* * * * *

UNITED STATES PATENT AND TRADEMARK OFFICE

CERTIFICATE OF CORRECTION

PATENT NO. : 4,926,826

DATED : May 22, 1990

INVENTOR(S) : Shimpei NAKANIWA et al.

It is certified that error appears in the above-indentified patent and that said Letters Patent is hereby corrected as shown below:

At column 1, line 11, change "a" to ---an---.

At column 2, line 3, insert ---a--- after "by".

At column 3, line 44, insert ---of--- after "control".

At column 3, line 68, delete "for".

At column 4, line 6, delete "for".

At column 5, line 48, change "coefficiency" to ---coefficient---.

At column 6, line 25, change "compution" to ---computing---.

At column 6, line 29, delete "meter".

At column 9, line 3, change "α cont" to ---λ cont---.

At column 10, lines 56-57, change "35 and 36 represents" to ---34 and 35 represent---.

At column 12, line 65, change "2" to ---102---.

At column 13, line 5, change "16" to ---20---.

At column 14, line 45, insert ---NB--- after "value" (second occurrence).

At column 17, line 39 (claim 7, line 10), delete "a" after "corresponding".

At column 17, line 42 (claim 7, line 13), change "fluction" to ---fluctuation---.

At column 17, line 66 (claim 8, line 23), change "action" to ---acting---.

UNITED STATES PATENT AND TRADEMARK OFFICE

CERTIFICATE OF CORRECTION

PATENT NO. : 4,926,826
DATED : May 22, 1990
INVENTOR(S) : Shimpei NAKANIWA et al.

It is certified that error appears in the above-indentified patent and that said Letters Patent is hereby corrected as shown below:

At column 18, line 4 (claim 8, line 29), change "output output" to ---output---.

At column 18, line 33 (claim 8, line 58), change "injection" to ---injecting--- after "for".

At column 18, line 66 (claim 12, line 1), insert ---apparatus--- after "control".

At column 19, line 14 (claim 14, line 1), delete "," after "control".

At column 19, line 35 (claim 15, line 13), change "fluction" to ---fluctuation---.

At column 22, line 9 (claim 23, line 13), change "fluction" to ---fluctuation---.

Signed and Sealed this

Third Day of January, 1995

*Attest:*

Bruce Lehman

BRUCE LEHMAN

*Attesting Officer*

*Commissioner of Patents and Trademarks*